US005747229A

United States Patent [19]

Hasegawa

[11] Patent Number: 5,747,229

[45] Date of Patent: May 5, 1998

[54] SOLID DEVELOPING COMPOSITION FOR PROCESSING SILVER HALIDE PHOTOGRAPHIC LIGHT-SENSITIVE MATERIAL AND PROCESSING METHOD EMPLOYING THE SAME

[75] Inventor: Takuji Hasegawa, Hino, Japan

[73] Assignee: Konica Corporation, Japan

[21] Appl. No.: 791,376

[22] Filed: Jan. 30, 1997

[30] Foreign Application Priority Data

Feb. 9, 1996 [JP] Japan ..... 8-023879

[51] Int. Cl.[6] ..... G03C 5/30

[52] U.S. Cl. ..... 430/465; 430/440; 430/446; 430/480; 430/483; 430/488

[58] Field of Search ..... 430/465, 488, 430/480, 463, 440, 446

[56] References Cited

U.S. PATENT DOCUMENTS

| | | | |
|---|---|---|---|
| 4,634,660 | 1/1987 | Mifune et al. | 430/375 |
| 4,683,189 | 7/1987 | Idota et al. | 430/248 |
| 4,816,384 | 3/1989 | Fruge et al. | 430/465 |
| 5,278,036 | 1/1994 | Kobayashi et al. | 430/465 |
| 5,385,811 | 1/1995 | Hirano | 430/488 |
| 5,441,847 | 8/1995 | Fukawa et al. | 430/488 |
| 5,510,231 | 4/1996 | Komatsu et al. | 430/465 |

FOREIGN PATENT DOCUMENTS

| | | |
|---|---|---|
| 053700 | 12/1993 | European Pat. Off. . |
| 0622671 | 2/1994 | European Pat. Off. . |
| 9603677 | 2/1996 | WIPO . |

*Primary Examiner*—Hoa Van Le

*Attorney, Agent, or Firm*—Jordan B. Bierman; Bierman, Muserlian and Lucas

[57] ABSTRACT

A solid developing composition for processing a silver halide photographic light sensitive material is disclosed which contains a compound represented by the following formula (1) and a compound represented by the following formula (2): formula (1)

formula (2)

9 Claims, No Drawings

SOLID DEVELOPING COMPOSITION FOR PROCESSING SILVER HALIDE PHOTOGRAPHIC LIGHT-SENSITIVE MATERIAL AND PROCESSING METHOD EMPLOYING THE SAME

FIELD OF THE INVENTION

The present invention relates to a solid developing composition for processing a silver halide photographic light sensitive material and a processing method employing the same.

BACKGROUND OF THE INVENTION

Recently, rapid processing or reduction of a processing solution has been increasingly promoted in photographic processing. As for rapid processing, processing is conducted at high temperature employing an automatic processor. As for light sensitive material, a light sensitive material is required which has excellent developability and fixibility to be processed rapidly and which can be quickly dried after washing. The reduction of a processing replenisher is also required in view of environmental protection. Current processing replenisher has been a processing solution prepared by diluting a concentrated processing solution in a processing kit with water, however, the kit has problems in excessive weight, additional storage space and disposal of the waste vessel. Accordingly, the processing composition in the kit is preferably a solid.

When a light sensitive material is running processed with a processing solution while replenishing a processing replenisher in a reduced amount, a component such as an inhibitor or a halide contained in the light sensitive material is dissolved out in the processing solution or a component compound contained in the processing solution is adsorbed onto the light sensitive material and carried over out of the processing solution. As a result, the composition of the processing solution or the component compound content of the processing solution fluctuates. In order to obtain stable photographic properties, a processing solution is replenished with a processing replenisher, and in order to stabilize the running processing activity, a starter (a development initiator) is added in an initial processing stage to the processing solution. However, it has been found that when a light sensitive material (film) is running processed with a developer which is replenished in a reduced replenishing amount (not more than 200 ml/m$^2$ as in the invention) with a developer replenisher prepared by dissolving a solid developing composition comprising a reducton developing agent in water, the resulting silver image tone deteriorates to a yellowish color.

There are hitherto various methods to improve the silver image tone, for example, a method to add an inhibitor such as 1-phenyl-5-mercaptotetrazole to the processing solution or the light sensitive material. Any of these methods do not give satisfactory results, but have problems of their own such as sensitivity fluctuation or solubility of the solid processing composition.

SUMMARY OF THE INVENTION

An object of the invention is to provide a solid processing composition and a processing method employing the same, which can provide stable photographic performance without deterioration of the silver image tone, particularly when a silver halide photographic light sensitive material is running processed with a developer which is replenished in a reduced replenishing amount of a developer replenisher prepared by dissolving the solid developing composition in water.

DETAILED DESCRIPTION OF THE INVENTION

The above object of the invention could be attained by the following method:

(1) a solid developing composition for processing a silver halide photographic light sensitive material, wherein the composition contains a compound represented by the following formula (1) and a compound represented by the following formula (2): formula (1)

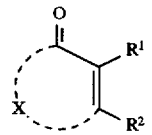

wherein $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring, formula (2)

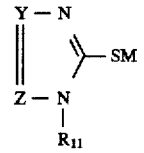

wherein Y and Z independently represent N or $CR_{12}$ in which $R_{12}$ represents a hydrogen atom or a substituted or unsubstituted alkyl or aryl group; and $R_{11}$ represents an alkyl or aryl group, each having at least one sulfo, carboxyl or hydroxy group as a substituent, provided that when the alkyl or aryl group has two or more substituents, the substituents may be the same or different; and M represents a hydrogen atom, an alkali metal atom, a quaternary ammonium group or a group capable of forming a hydrogen atom or an alkali metal atom under an alkaline condition, (2) a method of processing a silver halide photographic light sensitive material comprising the steps of:

developing the light sensitive material with a developer; and replenishing a developing replenisher to the developer, the developing replenisher being prepared by dissolving in water a solid developing composition containing the compound represented by formula (1) and the compound represented by formula (2) described in item (1) above, or (3) the method of item (2) above, wherein the developing replenisher is replenished in an amount of not more than 200 ml/M$^2$ of light sensitive material.

Next, the invention will be explained in detail.

The compound represented by formula (1) in the invention will be explained.

In formula (1), $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a ring, preferably comprising a carbon atom, a nitrogen atom or an oxygen atom, and to form a 5- or 6-membered ring together with the carbon atom of the carbonyl group and the two carbon atoms of the vinyl group having substituents $R_1$ and $R_2$. Exemplarily, $R_1$ and $R_2$ independently represent a hydroxy group, an amino group (including a substituted amino group having as a substituent an alkyl group with 1 to 10 carbon atoms such as methyl, ethyl, n-butyl, hydroxyethyl), an acylamino group (for example, acetylamino, benzoylamino), an alkylsulfonylamino group (for example, methanesulfonylamino), an arylsulfonylamino group (for example, benzenesulfonylamino, p-toluenesulfonylamino), an alkoxycarbonylamino group (for example, methoxycarbonylamino), a mercapto group or an alkylthio group (for example, methylthio, ethylthio). The preferable $R_1$ and $R_2$ are a hydroxy group, an amino group, an acylamino group, an alkylsulfonylamino group, or an arylsulfonylamino group. X is comprised of preferably a carbon atom, a nitrogen atom or an oxygen atom, and an atomic group necessary to form a 5- or 6-membered ring together with the carbon atom of the carbonyl group and the two carbon atoms of the vinyl group having substituents $R_1$ and $R_2$. The example of X includes —O—, —C($R_3$)($R_4$)—, —C($R_5$)=, —C(=O)—, —N($R_6$)—, and—N=, wherein $R_3$, $R_4$ $R_5$ and $R_6$ independently represent a hydrogen group, a hydroxy group, a carboxy group, an alkyl group with 1 to 10 carbon atoms, which may have a substituent including a hydroxy group, a carboxy group and a sulfo group, or an aryl group with 6 to 15 carbon atoms, which may have a substituent including an alkyl group, a halogen atom, a hydroxy group, a carboxy group and a sulfo group. The 5- or 6-membered ring may be a saturated or unsaturated condensed ring. The example of the 5- or 6-membered ring includes a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and an uracil ring, and the preferable are a dihydrofuranone ring, a cyclopentenone ring, a cyclohexenone ring, a pyrazolinone ring, an azacyclohexenone ring or an uracil ring. The example of the compound represented by formula (1) in the invention is listed below, but is not limited thereto.

A-1

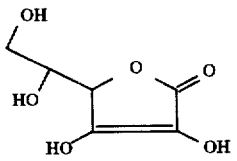

A-2

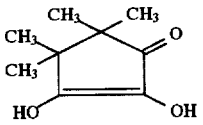

A-3

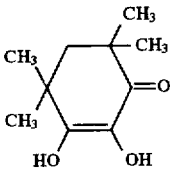

-continued

A-4

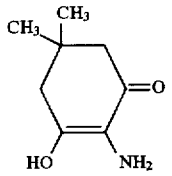

A-5

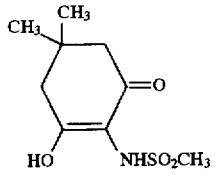

A-6

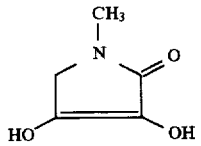

A-7

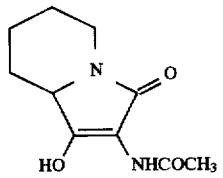

A-8

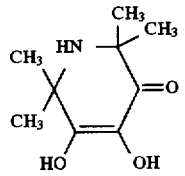

A-9

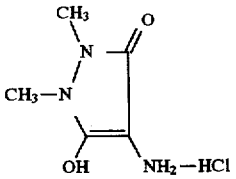

A-10

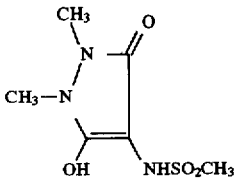

A-11

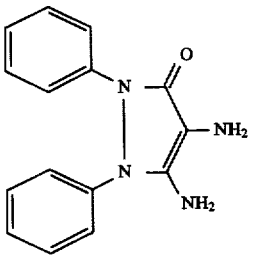

-continued

A-12

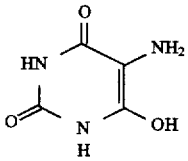

A-13

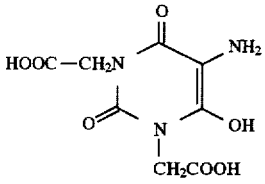

A-14

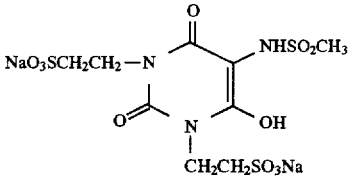

A-15

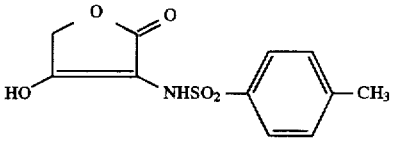

A-16

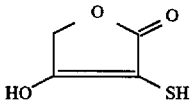

A-17

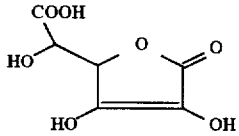

A-18

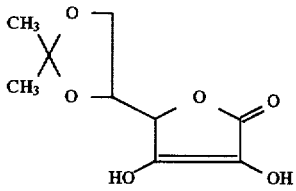

A-19

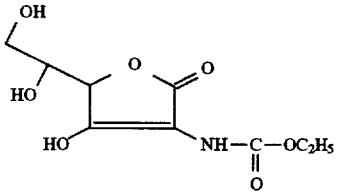

A-20

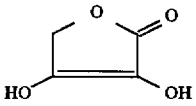

A-21

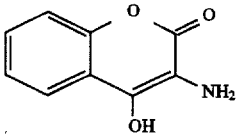

-continued

A-22

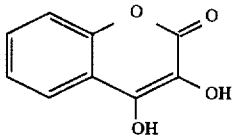

A-13 The compound represented by formula (1) in the invention may be in the form of acid or salt, whose example will be described later. The especially preferable compound is L-ascorbic acid, erythorbic acid or their salts. The content thereof in a developer is preferably 0.005 to 0.200 mol, more preferably 0.020 to 0.060 mol per liter.

A-14 The solid developing composition of the invention contains the compound represented by formula (1) in an amount of preferably 10 to 80 weight %, and more preferably 20 to 65 weight %.

The compound represented by formula (2) will be explained.

A-15 In formula (2), $R_{11}$ represents a straight-chained or branched alkyl group (for example, methyl, ethyl, propyl, hexyl, dodecyl or isopropyl) with 1 to 20 carbon atoms having at least one sulfo, carboxyl or hydroxy group as a substituent, a cycloalkyl group (for example, cyclopropyl or cyclohexyl) with 1 to 20 carbon atoms having at least one sulfo, carboxyl or hydroxy group as a substituent, an aryl group with 6 to 20 carbon atoms (for example, phenyl or naphthyl) having at least one sulfo, carboxyl or hydroxy group as a substituent.

A-16 A-17 A-18 A-19 A-20 A-21 The alkyl group (the straight-chained or branched alkyl or cycloalkyl group) further has another substituent including a halogen atom (such as F, Cl, Br), an alkyl group (such as methyl, ethyl), an aryl group (such as phenyl), an alkoxy group (such as methoxy, ethoxy), an aryloxy group (such as phenoxy), a sulfonyl group (such as methanesulfonyl, p-toluenesulfonyl), a carbamoyl group (such as unsubstituted carbamoyl, diethylcarbamoyl), an amido group (such as acetamido, benzamido), an alkoxycarbonylamino (such as methoxycarbonylamino), an aryloxycarbonylamino (such as phenoxycarbonylamino), an alkoxycarbonyl (such as methoxycarbonyl), an aryloxycarbonyl (such as phenoxycarbonylamino), an amino group (such as unsubstituted amino, dimethylamino), an alkylsulfinyl group (such as methylsulfinyl), an arylsulfinyl group (such as phenylsulfinyl), an alkylthio group (such as methylthio), and an arylthio group (such as phenylthio). The alkyl or aryl group represented by $R_{12}$ is the same as those denoted in $R_{11}$, and the substituent is also the same as those denoted in $R_{11}$. $R_{11}$, is especially preferably a phenyl group having one or more hydroxy, carboxy or hydroxy group as a substituent, and $R_{12}$ is especially preferably a hydrogen atom. M represents a hydrogen atom, an alkali metal atom (such as a sodium atom or a potassium atom), a quaternary ammonium group (such as trimethylammonium, dimethylammonium or tributylammonium) or a group (such as acetyl, cyanoethyl or methanesulfonyl) capable of forming a hydrogen atom or an alkali metal atom under an alkaline circumstance).

The example of the compound represented by formula (2) in the invention is listed below, but is not limited thereto.

(1)
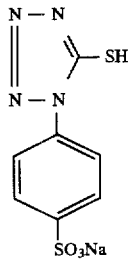
(2)
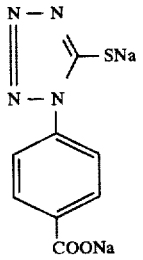
(3)
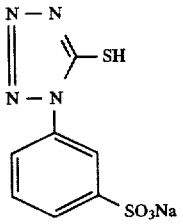
(4)
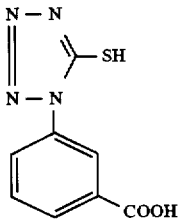
(5)
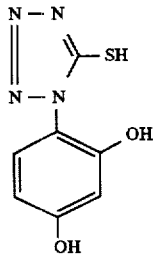
(6)
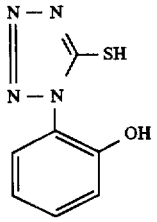
-continued
(7)
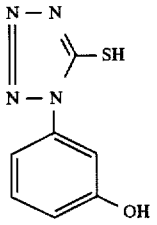
(8)
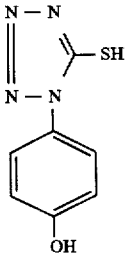
(9)
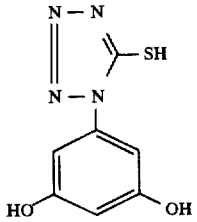
(10)
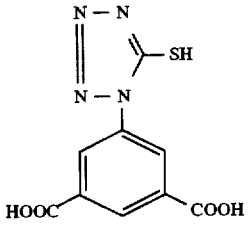
(11)
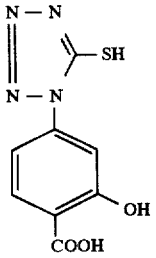
(12)
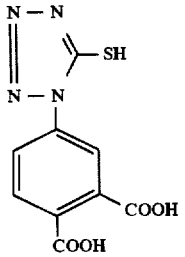

-continued
(13)
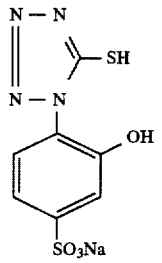
(14)
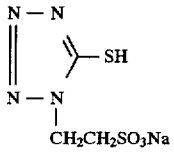
(15)
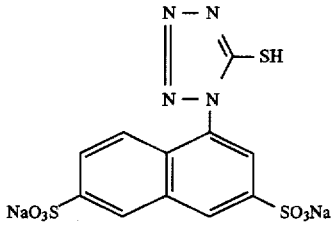
(16)
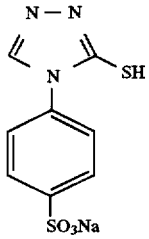
(17)
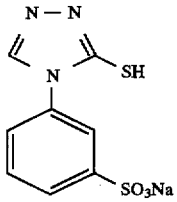
(18)
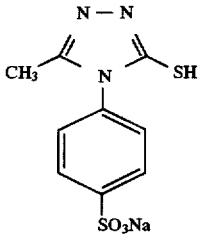
(19)
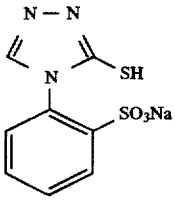
-continued
(20)
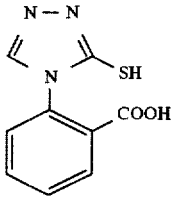
(21)
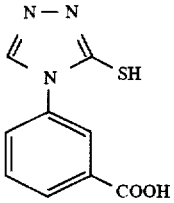
(22)
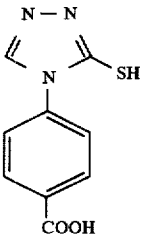
(23)
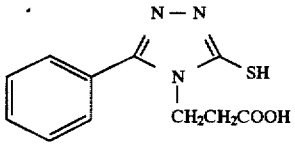
(24)
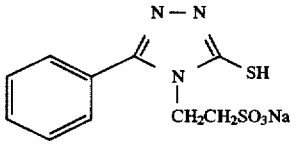
(25)
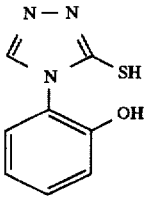
(26)
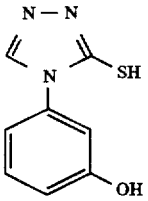
(27)
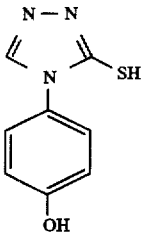

-continued (28)

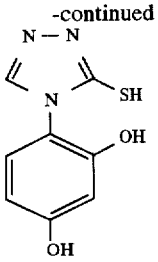

(29)

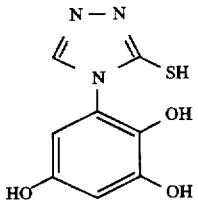

(30)

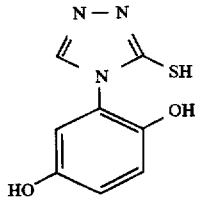

(31)

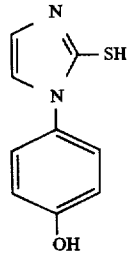

(32)

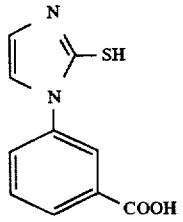

(33)

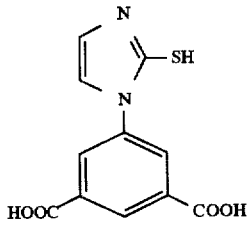

(34)

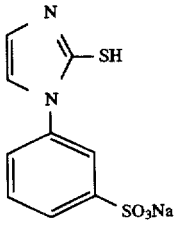

-continued (35)

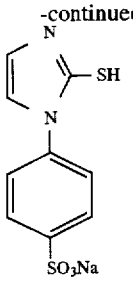

(36)

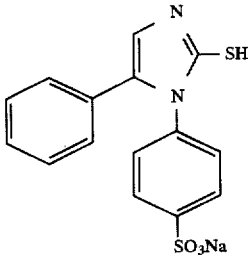

(37)

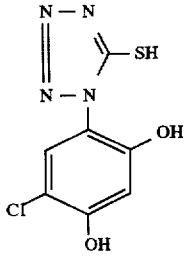

(38)

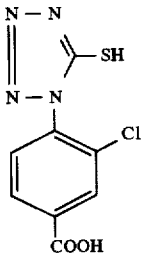

The compound represented by formula (2) can be easily prepared according to the well-known method from isocyanates as a starting material. The content of the compound represented by formula (2) in a developer (a working developer) is preferably 0.01 to 50 millimole, more preferably 0.05 to 10 millimole, and still more preferably 0.1 to 5 millimole, per liter.

The solid developing composition of the invention contains the compound represented by formula (2) in an amount of preferably 0.05 to 2 weight %, and more preferably 0.1 to 1 weight %.

The solid developing composition of the invention preferably contains, as developing agents, dihydroxybenzenes, aminophenols or pyrazolidones disclosed in Japanese Patent O.P.I. Publication No. 6-138591 (pages 19–20). Of pyrazolidones, one having a substituent at 4-position, dimeson or dimeson S, is especially preferable in view of water solubility or storage stability of solid developer. Hydroquinone is preferable as the dihydroxybenzenes, and N-methyl-p-aminophenol is preferable as the aminophenols.

It is preferable that the solid developing composition of the invention further contains a binder. The binder includes sugaralcohols such as mannitol (D- or L-mannitol) and sorbitol (D- or L- sorbitol), and dextrins such as dextrin and cyclodextrin. The solid developing composition of the invention contains the binder in an amount of preferably 5 to 50 weight %, and more preferably 10 to 30 weight %.

The solid developing composition of the invention may further contain a preservative, amines, a buffer, a developing accelerator, an anti-foggant, and other additives.

As the preservative can be used sulfites disclosed in Japanese Patent O.P.I. Publication No. 6-138591 or organic reducing agents. Besides the above, chelating agents or bisulfite adducts of hardeners disclosed in Japanese Patent O.P.I. Publication No. 6-138591 (pages 20–21) are used. As a antisludging agents are preferably used compounds disclosed in Japanese Patent O.P.I. Publication No. 6-308680. Cyclodextrins are also preferable, and compounds disclosed in Japanese Patent O.P.I. Publication No. 1-124853/1989 are especially preferable.

As the amines, the compounds disclosed in U.S. Pat. No. 4,269,929 are especially preferable.

Examples of the buffers include sodium carbonate, potassium carbonate, sodium bicarbonate, potassium bicarbonate, trisodium phosphate, tripotassium phosphate, disodium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

As the developing accelerator can be optionally added thioether compounds, p-phenylenediamine compounds, quaternary ammonium salts, p-aminophenols, polyalkylene oxides, 1-phenyl- 3-pyrazolidones, hydrazines, meso-ionic compounds, ionic compounds and imidazoles.

As the antifoggant can be used an alkali metal halide such as potassium iodide or organic antifoggants. The organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole and hydroxyazaindolidine, adenine and 1-phenyl-5-mercaptotetrazole as a representative.

The other additives include antistaining agents, antisludging agents and interlayer effect increasing agents.

To the fixer of the invention may be added the conventional fixing agent. The fixing agent, a chelating agent, a pH buffering agent, a hardener, and a preservative can be added which are disclosed in Japanese Patent O.P.I. Publication Nos. 4-242246/1992 (page 4) and 5-113632/1993 (pages 2–4). Besides the above, chelating agents or bisulfite adducts of hardeners disclosed in Japanese Patent Application No. 4-586323/1992 (pages 20–21) or the well-known fixing accelerator are used as hardeners.

Before processing, starter is preferably added, and solidified starter is also preferably added. As starter, organic acids such as polycarboxylic acid compounds, alkali metal halides such as KBr, organic inhibitors and developing accelerators are used.

The solid developing composition of the invention may be in the form of powder, granules or tablets, and is preferably in the form of granules or tablets.

In order to solidify the photographic processing composition, any method can be used in which concentrated solution or a mixture of fine-powdered or granule processing agents with a water soluble binder is kneaded and molded or pre-molded processing agent is coated with a covered layer by spraying a water soluble binder. (See JP Application Nos. 2-135887/1990, 2-203165/1990, 2-203166/1990, 2-203167/1990, and 2-300405/1990.)

The preferable method for preparing tablets is a method in which a powdered processing composition is granulated and the resulting granules are tableted to obtain tablets. The tablets prepared by the above have advantages that solubility and storage stability are improved and stable photographic properties are obtained as compared with those prepared by the method that the solid processing composition is only mixed and then tableted.

As for the granulating processes for forming tablets, it is possible to use any of the well-known processes such as the processes of a rolling granulation, an extrusion granulation, a compression granulation, a cracking granulation, a stirring granulation, a fluidized-layer granulation and a spray-dry granulation. When the granules are mixed and compressed to obtain tablets, the average particle size of the granules is to be within the range of preferably 100 to 8 †m and more preferably 200 to 700 †m in that localization of components or so-called segregation occurs with difficulty. As to particle size distribution, not less than 60% of the granules have a deviation of preferably 200 to 250 †m. The granules are used as they are.

When the granules are compressed, the well known compressors such as a hydraulic press machine, a single tableting machine, a rotary tableting machine and a bricketing machine can be used. The resulting solid processing composition may be in any form, and preferably in cylindrical form in view of productivity, handling or loose powder occurred in use.

It is preferable that each component, for example, an alkali agent, a reducing agent, or a preservative, is separately granulated. As a result, the above effects become more remarkable.

A tablet type processing composition can be prepared in any well known process or the method detailed in JP O.P.I. Publication Nos. 51-61837/1976, 54-155038/1979 and 52-88025/1977 and British Patent No. 1,213,808. Also, the preparation of the granulated processing composition is detailed in JP O.P.I. Publication Nos. 2-109042/1990, 2-109043/1990, 3-39735/1991 and 3-39739/1991. Further, a powder type processing composition can be prepared in any well known process as detailed in JP O.P.I. Publication No. 54-133332/1979, British Patent Nos. 725,892 and 729,862 and German Patent No. 3,733,861.

From the viewpoint of solubility and the desired effect of the present invention, the bulk density of the solid developing composition of the invention is preferably 1.0 to 2.5 $g/cm^3$; this range is preferable from the viewpoint of solid strength for the lower limit and solid solubility for the upper limit. When the solid processing composition is of granule or powder form, the bulk density is preferably 0.40 to 0.95 $g/cm^3$.

Although solidification of part of a processing composition is included in the present invention, it is preferable to solidify the entire components of the processing composition. Desirably, each component is formed as a separate solid processing agent and packaged in the same package. It is also desirable to package each component in the order of repeated addition.

It is preferable to solidify all processing agents to be supplied to the respective processing tanks according to information on the processing amount. Where necessary, replenishing water is supplied on the basis of such information or other replenishing water controlling information. In this case, the liquid added to the processing tanks may be replenishing water alone. In other words, when two or more processing tanks require replenishment, by sharing the replenishing water, only one tank is sufficient to store the replenishing liquid, resulting in automatic processor size reduction. The replenishing water tank may be installed outside or inside the automatic processor machine. It is preferable in view of space saving that the replenishing water tank be installed inside the automatic processor.

A packaging material for the solid processing composition can be embodied by making use of the following materials.

As for a synthetic resin material, any material can be used upon selecting them from the group consisting of polyethylene (prepared in either a high-pressure method or a low-pressure method), polypropylene (prepared in either a non-stretching method or a stretching method), polyvinyl chloride, polyvinyl acetate, Nylon (either stretched or non-stretched), polyvinylidene chloride, polystyrene, polycarbonate, Vinylon, Eval, polyethylene terephthalate (PET), other polyesters, rubber hydrochloride, acrylonitrile-butadiene copolymer and an epoxy-phosphoric acid type resin (that is a polymer described in JP O.P.I. Publication Nos. 63-63037/1988 and 57-32952/1982). Besides the above, a pulp may also be used.

As for the means of supplying a solid processing composition to a processing tank and in the case that the solid processing composition is of the tablet type, for example, there is such a well-known means as described in JP Utility Model Nos. 63-137783/1988, 63-97522/1988 and 1-85732/1989. In short, any means can also be used for this purpose, provided, the means has at least a function for supplying a tablet to a processing tank. In the case that a solid processing composition is of the granule or powder type, there is a well-known means such as a gravitationally dropping type means described in Japanese Utility Model O.P.I. Publication Nos. 62-81964/1987, 63-84151/1988 and JP O.P.I. Publication No. 1-292375/1989 and such a propeller or screw type means as described in Japanese O.P.I. Utility Model Publication Nos. 63-105159/1988 and 63-195345/1988. However, the invention shall not be limited thereto.

As for a preferable means for supplying a solid processing composition to a processing tank, it may be considered to use such a means, for example, that a specific amount of a solid processing composition already weighed and separately put in a package in advance is opened and taken out of the package so as to meet the quantity of light-sensitive material to be processed. To be more concrete, every specific amount of a solid processing composition, that is preferably a replenishing amount thereof for every replenishment, is contained in a package that is sandwiched between at least two packaging materials, and the amount of the composition is then made to be in a state where it can be taken out by separating the packages to two directions or opening a part of the processing composition. The processing composition in the state where it can be readily taken out can be readily supplied to a processing tank provided with a filtering means by naturally dropping the composition. A specific amount of every processing composition is put in a separate tight-sealed package so that the atmospheric air and the aeration between it and any other solid processing composition adjacent thereto can be shielded. Therefore, it is preferable that the package is secured to resist any moisture invasion.

As for an embodiment of the invention, the following constitution may be considered that a package is so comprised of at least two packaging materials as to sandwich a solid processing composition between the packaging materials, and the two packaging materials are brought into close contact with or are made adhered to each surface thereof so that the surroundings of the processing composition can be separated apart. When the two packaging materials sandwiching the processing composition between them is pulled toward the different directions from each other, the close contacted or adhered surfaces are separated apart, so that the processing composition can be made in the state where it is ready to be taken out.

As for another embodiment of the invention, it may be considered that a package is so composed of at least two packaging materials as to sandwich a solid processing composition between the packaging materials, and one of the two packaging materials can be opened by applying an external force. The expression "to open a package" herein means a partial notch or partial cut of a packaging material remaining the rest thereof unnotched or uncut. A method of opening a package is that a compression is applied from a package on the side of not opening it, through a solid processing composition, to the direction of the other package to be opened, so that the solid processing composition is forcibly pushed out. Or, it may also be considered that a solid processing composition is made ready to be opened by making a partial cut or-notch on a package on the side where the package is to be opened by making use of a sharp-edged member.

A supply starting signal is generated by detecting information on the amount of processing. A supply stopping signal is generated by detecting information on the completion of supply of a specified amount. When a processing agent is packed separately and it is necessary to unseal it, upon reception of such supply starting signal, the driving means for separation or opening, and upon reception of such supply stopping signal, the driving means for separation or opening is disabled.

The above solid processing agent supplying means is equipped with a controlling means for adding a given amount of the solid processing agent according to information on the amount of processing of light-sensitive material, which constitutes a key to the present invention.

The information on the amount of processing of silver halide photographic light-sensitive material is a value in proportion to the amount of the silver halide photographic light-sensitive material to be processed by a processing solution or the amount of the silver halide photographic light-sensitive material already processed by a processing solution or the amount of the silver halide photographic light-sensitive material being processed by a processing solution, offering a direct or indirect index of the reduction in the amount of the processing agent in the processing solution. This information may be detected at any timing, before or after light-sensitive material transportation into the processing solution or during its immersion in the processing solution. It may also be physical parameters such as the concentration of the processing solution contained in the processing tank, concentration change, pH or specific gravity or the amount discharged after drying the processing solution.

Usually, the automatic processing machine is equipped with an electric heater to warm processing solutions, wherein, as a general method, a heat exchanger is provided in the auxiliary tank connected to the processing layer, which auxiliary tank is equipped with a pump for supplying the solution at constant rate from the processing tank to have constant temperature.

A filter is usually arranged to remove crystalline foreign substances occurring due to contamination or crystallization in the processing solution. A dissolving tank can be connected to a portion communicating with the processing portion as this auxiliary tank.

For the filter and filtering apparatus, any material can be used, as long as it is commonly used in ordinary automatic processing machines, and the effect of the present invention is not affected by any particular structure or material.

A circulation cycle of a processing solution circulated by a circulating means in the invention is preferably 0.5 to 2.0 cycles/min, more preferably 0.8 to 2.0 cycles/min, 1.0 to 2.0 cycles/min is specifically more preferable. Here, the circulation cycle is defined to be the flow amount of liquid circulated, and when a liquid amount corresponding to the total liquid amount in the processing tank is counted as one time.

The replenishing amount is not more than 200 ml, and preferably not more than 150 ml per $m^2$ of light sensitive material, and it is greatly reduced as compared with the replenishing amount (280 ml or more per $m^2$ of light sensitive material) hitherto in use.

The automatic processor used in the invention may be various type processors such as a roller transporting type and a belt transporting type. The roller transporting type processor is preferable. In order to minimize air oxidation or evaporation of developer, it is effective to reduce an aperture value of the developer tank in the automatic processor.

In the invention, the developing time refers to the time from when a leading edge of light sensitive material enters into a developer in the developing tank until the edge enters into a fixer in the next fixing tank, the fixing time refers to the time from when the edge enters into the fixer until the edge enters into a washing water in the next washing tank, and the washing time refers to the time while the light sensitive material is immersed in the washing water. The drying time refers to the time from after the material passes between squeezing rollers whereby the washing water is squeezed until it exits the drying zone in which hot air is supplied.

In the invention, the developing time is 5 to 60 seconds, preferably 5 to 30 seconds, and the developing temperature is 20 to 50° C., preferably 25 to 40° C.

The fixing time is 5 to 60 seconds, preferably 5 to 30 seconds, and the fixing temperature is 20 to 50° C., preferably 25 to 40° C.

The temperature and time in washing light sensitive material with a washing water are preferably 10 to 40° C and 5 to 50 seconds, respectively. An anti-mold, an anti-fungal or a surfactant may be added to the washing water.

In the invention, the total processing time (Dry to Dry) is preferably 100 seconds or less, and more preferably 70 seconds or less.

The light sensitive material used in the invention is not specifically limited, but the preferable will be explained below.

An emulsion used for the silver halide photographic light sensitive material of the present invention can be produced by a conventional method.

The preferably used silver halide emulsion is a monodispersed emulsion having high iodide content inside disclosed in Japanese Patent O.P.I. Publication Nos. 59-177535, 61-802237, 61-132943, 63-49751 and 2-85846. The crystal habit may be cubic, tetradecahedral, octahedral, or crystals having a (111) and (100) face.

The crystal structure of silver halide may be composed of a silver halide composition wherein inside and outside are different. The preferable emulsion is a core/shell type monodispersed emulsion having a two-layer structure wherein a core portion of high iodide content is covered with a shell layer of low iodide content. The silver iodide content in the high iodide content portion is 20 to 40 mol%, and preferably 20 to 30 mol%.

Another silver halide emulsion preferably used in the invention is tabular silver halide grains having an aspect ratio of 1 or more. Such tabular grains improve spectral sensitization efficiency, image graininess or image sharpness.

For the emulsion used in the silver halide photographic light sensitive material of the invention, various additives for photographic use can be used in a step before or after physical ripening or chemical ripening. Hydrazine compounds may be added. The compounds disclosed in Japanese Patent O.P.I. Publication No. 6-347938 are preferable and a compound represented by Formula (5) and a nuclear accelerating compound represented by Formula (6) or (7) are especially preferable. Tetrazolium compounds may also be added, and those disclosed in Japanese Patent O.P.I. Publication No. 2-250050/1990 are preferable. Besides the above compounds, the conventional additives include various compounds described in (RD)Nos. 17643(December, 1978), 18716(November, 1979) and 308119(December, 1989) can be used. Locations where the compounds are described in these three (RD) are shown below:

| | RD-17643 | | | RD-308119 | |
|---|---|---|---|---|---|
| Additive | Page | Classification | RD-18716 Page | Page | Classification |
| Chemical Sensitizer | 23 | III | 648 upper right | 996 | III |
| Sensitizing Dye | 23 | IV | 648–649 | 996–8 | IV |
| Desensitizing Dye | 23 | IV | | 998 | B |
| Dye | 25–26 | VIII | 649–650 | 1003 | VIII |
| Development Accelerating Agent | 29 | XXI | 648 upper right | | |
| Anti-foggant, Stabilizing Agent | 24 | IV | 649 upper right | 1006–7 | VI |
| Brightening Agent | 24 | V | | 998 | V |
| Hardener | 26 | X | 651 left | 1004–5 | X |
| Surfactant | 26–27 | XI | 650 right | 1005–6 | XI |
| Anti-static Agent | 27 | XII | 650 right | 1006–7 | XIII |
| Plasticizer | 27 | XII | 650 right | 1006 | XII |
| Slipping Agent | 27 | XII | | | |
| Matting Agent | 28 | XVI | 650 right | 1008–9 | XVI |
| Binder | 26 | XXII | | 1003–4 | IX |
| Support | 28 | XVII | | 1009 | XVII |

The support used in the silver halide photographic light-sensitive material of the invention includes a support described on page 28 of RD-17643 and on page 1009 of RD-308119 above.

EXAMPLES

The examples of the invention will be explained below, but the invention is not limited thereto.

Example 1

The developing initiator liquid and the solid processing composition regarding the invention were prepared as follows.

<Preparation of developer initiator LIQUID (starter)>

| | (Content based on 1 liter of developer) |
|---|---|
| Acetic acid (90%) | 8.2 g |
| KBr | 4.9 g |
| Pure water was add to make 20 cc. | |

<Preparation of Solid Developing Composition>

Granules (A1)

In a bandam mill available on the market were pulverized 400 g of 1-phenyl-3-pyrazolidone, 10 g of N-acetyl-D,L-penicilamine and 500 g of glutaraldehyde-sodium bisulfite to an average particle size of 10 μm. The resulting fine particles were added with a compound of formula (1) or (2) in an amount as shown in Table 1, 3000 g of hydroquinone, 4600 g of sodium sulfite, and a binder, mannitol in an amount necessary to give a total granule weight of 9000 g and mixed in a mill for 30 minutes. The resulting mixture was granulated by adding 30 ml of water at room temperature for about 10 minutes in a stirring granulator available on the market and dried at 40° C. for 2 hours in a fluid-bed drier to almost completely remove water.

Granules (B1)

DTPA.5Na of 300 g, 5800 g of potassium carbonate and 100 g of lithium hydroxide were independently pulverized in a bandam mill available on the market to an average particle size of 10 μm. Each of the resulting fine particles was mixed with 700 g of a binder, mannitol for 30 minutes, and granulated by adding 30 ml of water at room temperature for about 15 minutes in a stirring granulator available on the market and dried at 40° C. for 2 hours in a fluid-bed drier to almost completely remove water.

Each of granules (A1) and (B1) was added with 100 g of sodium 1-octane sulfonate, and mixed for 20 minutes in a mixer at 25° C. and at 40%RH or less. Each of the resulting mixtures was compression-tableted in an amount per tablet of 10 g, using Tough Press Correct Model 1527HU produced by Kikusui Seisakusho Co., Ltd., which was modified. Thus, solid developing tablets (A1) and (B1) were obtained.

A solid fixing composition was prepared in the following procedures.

Granules (A2)

In a bandam mill available on the market were pulverized 15,000 g of ammonium thiosulfate/sodium thiosulfate (90/10, weight ratio), 1,500 g of β-alanine and 4,000 g of sodium acetate to an average particle size of 10 μm. The resulting fine particles were added with 500 g of sodium sulfite, 570 g of $Na_2S_2O$ and 1,300 g of a binder, mannitol, granulated with stirring by adding 50 ml of water, and dried at 40° C. in a fluid-bed drier to almost completely remove water.

Granules (B2)

In the same manner as in granules (A2) were pulverized 700 g of boric acid, 1,500 g of aluminium sulfate-octadecahydrate, and 1,200 g of succinic acid. The resulting fine particles were added with 200 g of sodium hydrogen sulfate and 300 g of a binder, mannitol, granulated with stirring by adding 30 ml of water, and dried at 40° C. in a fluid-bed drier to almost completely remove water.

Each of granules (A2) and (B2) was added with 150 g of sodium 1-octane sulfonate, and uniformly mixed for 10 minutes in a mixer at 25° C. and at 40%RH or less. Each of the resulting mixtures was compression-tableted in an amount per tablet of 10 g, using Tough Press Correct Model 1527HU produced by Kikusui Seisakusho Co., Ltd., which was modified. Thus, solid fixing tablets (A2) and (B2) were obtained.

Each of the resulting tablets was packaged in an amount for 3.0 liter in an aluminium containing pillow-shaped package to prevent moisture absorption.

A developer was prepared by dissolving in water ten tablets of each of solid developing tablets (A1) and (B1) to make a 1 liter solution. In processing a light sensitive material, 7.8 liter of the developer were placed in the developing tank of an automatic processor, SRX-201 (produced by Konica Corporation), and starter was added. Thus, a starting developer was obtained, and processing was carried out using the starting developer. The starter was added to in proportion of 20 cc per liter of the developer.

Similarly, a fixer was prepared by dissolving in water twenty eight tablets of solid fixing tablet (A2) and four tablets of solid fixing tablet (B2) to make a 1 liter solution. The fixing tank of an automatic processor, SRX-201 was charged with 5.6 liter of the fixer. Thus, a starting fixer was obtained.

Each of the packages of developing and fixing tablets was opened, and set at each supplying inlet. Each of the tablets was incorporated from each inlet into the built-in chemical mixer and at the same time water (25–30° C.) was added. Each of the resulting mixture was stirred for 25 minutes to obtain a 3.0 liter solution. Thus, developer replenisher and fixer replenisher were obtained.

The pH of the developer prepared above was 10.50, and pH of the starting developer, in which the starter was added to the developer, was 10.30. The pH of the fixer prepared above was 4.80.

The chemical mixer is provided in a replenisher preparing tank and an auxiliary tank, each having a volume of 3.0 liter. The auxiliary tank is provided so that replenisher is supplied even when the replenisher prepared in the replenisher preparing tank is empty during running processing or when a solid processing composition is dissolved with stirring in the replenisher preparing tank.

An automatic processor SRX-201 (produced by Konica Corporation) was employed. The development temperature was 34° C., fixing temperature was 34° C., and drying temperature was 55° C. The total processing time was 60 seconds. The replenishing amount of the developer replenisher was shown in Table 1, and the replenishing amount of fixer replenisher was 180 cc/$m^2$. The following running processing and evaluation were carried out.

(Evaluation of Processing Stability)

The X-ray film SRG, produced by Konica Corporation, was exposed so as to give a density of 1.0 after processing. Two thousand 10 inch×12 inch exposed films were running processed according to the processing methods as shown in Table 1. Evaluation was carried out as follows:

(Sensitometry)

X-ray film SRG having a 10 inch×12 inch size was sandwiched between fluorescent screens SRO-250 (produced by Konica Corporation), exposed to X-ray at a tube potential of 90KVP and at a tube current of 20 mA for 0.05 seconds. The resulting film was processed with the processing solution before and after the running processing at each processing method. Sensitivity of the resulting films was obtained from the sensitometry curve according to a distant method. Sensitivity was represented by a reciprocal of exposure necessary to give a density of fog plus 1.0, and sensitivity was represented in terms of sensitivity relative to sensitivity of the film processed with the processing solution before the running processing in Processing No. 1 being defined as 100.

(Evaluation of Developed Silver Image Tone)

X-ray film SRG having a 10 inch×12 inch size was exposed so as to give a density of 1.0 after processing. Two thousand of the exposed films were running processed according to the processing methods as shown in Table 1.

X-ray film SRG was exposed so as to give a transmission density of 1.2 when the exposed film was processed with the processing solution before and after the running processing at each processing method employing the automatic processor described above. The processed film was put on a viewing box and its developed silver image tone was observed by the transmitted light.

The evaluation criteria were as follows:

1: Pure black

2: Slightly reddish black

3: Slightly yellowish black

4: Yellowish black

The results are shown in Table 1.

with 700 g of a binder, mannitol for 30 minutes, and granulated by adding 30 ml of water at room temperature for about 15 minutes in a stirring granulator available on the market and dried at 40° C. for 2 hours in a fluid-bed drier to almost completely remove water.

Each of granules (A3) and (B3) was added with 100 g of sodium 1-octane sulfonate, and mixed for 20 minutes in a mixer at 25° C. and at 40%RH or less. Each of the resulting mixture was compression-tableted in an amount per tablet of 10 g, using Tough Press Correct Model 1527HU produced by Kikusui Seisakusho Co., Ltd., which was modified. Thus, solid developing tablets (A3) and (B3) were obtained.

A developer was prepared by dissolving in water ten tablets of solid developing tablets (A3) and twelve tablets of solid developing tablets (B3) to make a 1 liter solution. The processing and evaluation were carried out in the same manner as in Example 1, except that this developer was used instead of the developer used in Example 1.

The results are shown in Table 2.

TABLE 1

| Processing method No. | Developer: formula (1) compound Kind | Developer: formula (1) compound Content (g/liter) | Developer: formula (2) compound Kind | Developer: formula (2) compound Content (g/liter) | Developer: Replenishing amount (ml/m²) | Sensitivity: Before running processing | Sensitivity: After running processing | Silver image tone: Before running processing | Silver image tone: After running processing | Remarks |
|---|---|---|---|---|---|---|---|---|---|---|
| 1 | — | — | — | — | 320 | 100 | 95 | 1 | 2 | Comp. |
| 2 | — | — | — | — | 180 | 100 | 80 | 1 | 4 | Comp. |
| 3 | A-1 | 5 | — | — | 180 | 102 | 95 | 1 | 4 | Comp. |
| 4 | — | — | (3) | 0.5 | 180 | 98 | 95 | 1 | 3 | Comp. |
| 5 | A-1 | 5 | (3) | 0.5 | 180 | 100 | 98 | 1 | 1 | Inv. |
| 6 | A-1 | 10 | (3) | 0.5 | 180 | 100 | 102 | 1 | 1 | Inv. |
| 7 | A-1 | 10 | (3) | 1.0 | 180 | 95 | 98 | 1 | 1 | Inv. |
| 8 | A-17 | 5 | (3) | 0.5 | 180 | 100 | 98 | 1 | 1 | Inv. |
| 9 | A-1 | 5 | (4) | 0.5 | 180 | 98 | 95 | 1 | 1 | Inv. |
| 10 | A-1 | 5 | (16) | 0.5 | 180 | 100 | 98 | 1 | 1 | Inv. |
| 11 | A-1 | 5 | *Comparative Compound | 0.2 | 180 | 90 | 85 | 1 | 4 | Comp. |

*Comparative Compound: 1-Phenyl-5-mercaptotetrazole

As is apparent from Table 1, the invention gives stable photographic performance in running processing.

Example 2

<Preparation of solid developing composition>

Granules (A3)

In a bandam mill available on the market were pulverized 400 g of 1-phenyl-3-pyrazolidone, 10 g of N-acetyl-D,L-penicilamine and 500 g of glutaraldehyde-sodium bisulfite to an average particle size of 10 μm. The resulting fine particles were added with a compound of formula (1) or (2) in an amount as shown in Table 2, 1600 g of sodium sulfite, and a binder, mannitol in an amount necessary to give a total granule weight of 9000 g and mixed in a mill for 30 minutes. The resulting mixture was granulated by adding 30 ml of water at room temperature for about 10 minutes in a stirring granulator available on the market and dried at 40° C. for 2 hours in a fluid-bed drier to almost completely remove water.

Granules (B3)

Three thousand gram of DTPA.5Na and 11,000 g of potassium carbonate were independently pulverized in a bandam mill available on the market to an average particle size of 10 μm. Each of the resulting fine particles was mixed

TABLE 2

| Processing method No. | Developer: formula (1) compound Kind | Developer: formula (1) compound Content (g/liter) | Developer: formula (2) compound Kind | Developer: formula (2) compound Content (g/liter) | Developer: Replenishing amount (ml/m²) | Sensitivity: Before running processing | Sensitivity: After running processing | Silver image tone: Before running processing | Silver image tone: After running processing | Remarks |
|---|---|---|---|---|---|---|---|---|---|---|
| 12 | A-1 | 40 | — | — | 320 | 100 | 95 | 1 | 2 | Comp. |
| 13 | A-1 | 40 | — | — | 180 | 100 | 85 | 1 | 4 | Comp. |
| 14 | A-1 | 40 | (3) | 0.5 | 180 | 98 | 95 | 1 | 1 | Inv. |
| 15 | A-1 | 40 | (3) | 1.0 | 180 | 95 | 92 | 1 | 1 | Inv. |
| 16 | A-1 | 40 | (4) | 0.5 | 180 | 100 | 102 | 1 | 1 | Inv. |
| 17 | A-1 | 40 | (16) | 0.5 | 180 | 100 | 98 | 1 | 1 | Inv. |
| 18 | A-17 | 40 | (3) | 0.5 | 180 | 100 | 98 | 1 | 1 | Inv. |
| 19 | A-1 | 40 | *Comparative Compound | 0.2 | 180 | 90 | 85 | 1 | 4 | Comp. |

*Comparative Compound: 1-Phenyl-5-mercaptotetrazole

As is apparent from Table 2, the invention gives stable photographic performance in running processing.

What is claimed is:

1. A solid developing composition for processing a silver halide photographic light sensitive material, wherein the composition contains a compound represented by the following formula (1) and a compound represented by the following formula (2), formula (1) and formula (2) being present in effective amounts to provide stable photographic performance without deterioration of image tone.

formula (1)

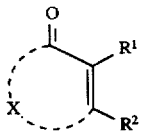

wherein $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring.

formula (2)

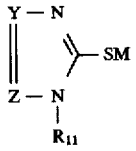

wherein Y and Z independently represent N or $CR_{12}$ in which $R_{12}$ represent a hydrogen atom or a substituted or unsubstituted alkyl or aryl group; and $R_{11}$ represents an alkyl or aryl group, each having at least one sulfo, carboxyl or hydroxy group as a substituent; and M represents a hydrogen atom, an alkali metal atom, a quaternary ammonium group or a group capable of being released under alkaline condition.

2. The solid developing composition of claim 1 wherein the composition contains said compound represented by formula (1) in an amount of 10 to 80 weight % and said compound represented by formula (2) in an amount of 0.05 to 2 weight %.

3. The solid developing composition of claim 1, wherein said $R_1$ and $R_2$ of formula (1) independently represent a hydroxy group, an amino group, an acylamino group, an alkylsulfonylamino group or an arylsulfonylamino group.

4. The solid developing composition of claim 1, wherein said X of formula (1) represents a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring or an uracil ring.

5. The solid developing composition of claim 4, wherein said X represents a dihydrofuranone ring, a cyclopentenone ring, a cyclohexenone ring, a pyrazolinone ring, an azacyclohexenone ring or an uracil ring.

6. The solid developing composition of claim 1, wherein said compound represented by formula (1) is 1-ascorbic acid, erythorbic acid or their salts.

7. The solid developing composition of claim 1, wherein in formula (2), said Y and Z independently represent N or $CR_{12}$ in which $R_{12}$ represents a hydrogen atom; and said $R_{11}$ represents an alkyl or aryl group, each having at least one sulfo, carboxyl or hydroxy group.

8. The solid developing composition of claim 1, further containing a developing agent.

9. The solid developing composition of claim 1, wherein said composition is in the form of granules or tablets.

* * * * *